US011826605B2

(12) United States Patent
Lagree et al.

(10) Patent No.: US 11,826,605 B2
(45) **Date of Patent: *Nov. 28, 2023**

(54) EXERCISE MACHINE CARRIAGE HANDLE SYSTEM

(71) Applicant: Lagree Technologies, Inc., Chatsworth, CA (US)

(72) Inventors: Sebastien Anthony Louis Lagree, Chatsworth, CA (US); John C. Hamilton, Santa Clarita, CA (US)

(73) Assignee: Lagree Technologies, Inc., Chatsworth (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/872,129

(22) Filed: Jul. 25, 2022

(65) Prior Publication Data

US 2022/0355158 A1 Nov. 10, 2022

Related U.S. Application Data

(63) Continuation of application No. 16/933,517, filed on Jul. 20, 2020, now Pat. No. 11,395,936, which is a (Continued)

(51) Int. Cl.
*A63B 21/00* (2006.01)
*A63B 21/02* (2006.01)
(Continued)

(52) U.S. Cl.
CPC ..... *A63B 21/4035* (2015.10); *A63B 21/023* (2013.01); *A63B 21/0428* (2013.01);
(Continued)

(58) Field of Classification Search
CPC ..... A63B 23/02–0244
See application file for complete search history.

(56) References Cited

U.S. PATENT DOCUMENTS 131,886 A 10/1872 Little
1,621,477 A 3/1927 Pilates
(Continued)

FOREIGN PATENT DOCUMENTS

WO 2004/096376 A1 11/2004

OTHER PUBLICATIONS https://web.archive.org/web/20121205030242/http:/www.lagreefitness.com:80/index.php?option=com_content&view=article&id=32&Itemid=3; Lagree Fitness Wayback Machine Archive.org Page; Dec. 5, 2012.

(Continued)

*Primary Examiner* — Nyca T Nguyen
(74) *Attorney, Agent, or Firm* — Neustel Law Offices

(57) ABSTRACT

An exercise machine carriage handle system for providing handles for an exerciser to grasp with their hands thereby expanding the type of exercises that may be performed. The exercise machine carriage handle system generally includes a frame having a track, a carriage movably connected to the track, a bias member connected between the frame and the carriage, a first handle connected to the carriage near the first side, and a second handle connected to the carriage near the second side. The first handle and second handle are adapted for grasping with a first hand and a second hand respectively of a user during the performance of an exercise on the exercise machine.

20 Claims, 6 Drawing Sheets

Related U.S. Application Data continuation of application No. 16/181,259, filed on Nov. 5, 2018, now Pat. No. 10,716,964, which is a continuation of application No. 15/465,773, filed on Mar. 22, 2017, now Pat. No. 10,118,067, which is a continuation of application No. 15/357,093, filed on Nov. 21, 2016, now Pat. No. 9,604,095, which is a continuation of application No. 15/237,263, filed on Aug. 15, 2016, now Pat. No. 9,498,667, which is a continuation of application No. 14/970,845, filed on Dec. 16, 2015, now Pat. No. 9,415,253.

(51) Int. Cl.

| | |
|---|---|
| ***A63B 22/00*** | (2006.01) |
| ***A63B 23/12*** | (2006.01) |
| ***A63B 23/00*** | (2006.01) |
| ***A63B 22/20*** | (2006.01) |
| ***A63B 21/055*** | (2006.01) |
| ***A63B 71/06*** | (2006.01) |
| ***A63B 23/035*** | (2006.01) |
| ***A63B 23/04*** | (2006.01) |
| ***A63B 21/04*** | (2006.01) |

(52) U.S. Cl.

CPC ..... *A63B 21/055* (2013.01); *A63B 21/4034* (2015.10); *A63B 21/4045* (2015.10); *A63B 22/0046* (2013.01); *A63B 22/0089* (2013.01); *A63B 23/03508* (2013.01); *A63B 23/03516* (2013.01); *A63B 23/03575* (2013.01); *A63B 23/04* (2013.01); *A63B 23/12* (2013.01); *A63B 71/0622* (2013.01); *A63B 21/00065* (2013.01); *A63B 22/001* (2013.01); *A63B 22/0007* (2013.01); *A63B 22/203* (2013.01); *A63B 2023/003* (2013.01); *A63B 2071/0633* (2013.01); *A63B 2071/0694* (2013.01); *A63B 2208/0219* (2013.01); *A63B 2208/0223* (2013.01); *A63B 2225/09* (2013.01)

(56) References Cited

U.S. PATENT DOCUMENTS

| | | | | |
|---|---|---|---|---|
| 1,866,868 | A | 7/1932 | Thomson | |
| 2,223,309 | A | 4/1940 | Swanson | |
| 3,130,968 | A * | 4/1964 | De Feen | A63B 23/00 297/344.13 |
| 3,589,720 | A * | 6/1971 | Agamian | A63B 22/203 482/114 |
| 3,770,267 | A | 11/1973 | McCarthy | |
| 3,795,396 | A | 3/1974 | Kropeinitski | |
| 3,806,094 | A | 4/1974 | Harken | |
| 4,231,375 | A | 11/1980 | Boehringer | |
| 4,620,701 | A | 11/1986 | Mojden | |
| 4,706,953 | A | 11/1987 | Graham | |
| 4,709,920 | A | 12/1987 | Schnell | |
| 4,759,540 | A | 7/1988 | Yu | |
| 4,798,378 | A | 1/1989 | Jones | |
| 4,845,987 | A | 7/1989 | Kenneth | |
| 4,911,438 | A | 3/1990 | Van Straaten | |
| 5,007,632 | A | 4/1991 | Wilkinson | |
| 5,066,005 | A | 11/1991 | Luecke | |
| 5,139,471 | A | 8/1992 | Dornberger | |
| 5,179,746 | A | 1/1993 | Rogers | |
| 5,211,617 | A | 5/1993 | Millen | |
| 5,263,913 | A | 11/1993 | Boren | |
| 5,295,935 | A * | 3/1994 | Wang | A63B 21/4033 482/130 |
| 5,358,462 | A | 10/1994 | Calderone | |
| 5,374,226 | A | 12/1994 | Grahm | |
| 5,380,259 | A | 1/1995 | Robertson | |
| 5,429,567 | A | 7/1995 | Gerschefske | |
| D362,700 | S | 9/1995 | Breibart | |
| D382,319 | S | 8/1997 | Gerschefske | |
| 5,681,249 | A | 10/1997 | Endelman | |
| 5,792,033 | A | 8/1998 | Merrithew | |
| 5,833,588 | A | 11/1998 | Connelly, III | |
| 5,857,946 | A | 1/1999 | Brown | |
| 5,885,197 | A * | 3/1999 | Barton | A63B 21/068 482/145 |
| 5,938,571 | A | 8/1999 | Stevens | |
| 5,941,803 | A | 8/1999 | Chamberlain | |
| 5,967,955 | A | 10/1999 | Westfall | |
| 5,997,450 | A | 12/1999 | Wilkinson | |
| 6,042,523 | A | 3/2000 | Graham | |
| 6,045,491 | A | 4/2000 | McNergney | |
| 6,179,753 | B1 | 1/2001 | Barker | |
| 6,196,954 | B1 | 3/2001 | Chen | |
| 6,315,695 | B1 | 11/2001 | Foilett | |
| 6,461,283 | B1 | 10/2002 | Maron | |
| 6,607,472 | B2 | 8/2003 | Toole | |
| 6,652,425 | B1 | 11/2003 | Martin | |
| 7,163,500 | B2 | 1/2007 | Endelman | |
| 7,803,095 | B1 * | 9/2010 | LaGree | A63B 22/0089 482/121 |
| 7,819,777 | B1 | 10/2010 | Service | |
| 7,931,570 | B2 | 4/2011 | Hoffman | |
| 7,942,799 | B1 | 5/2011 | Boyd | |
| 659,205 | A1 | 5/2012 | Endelman | |
| 8,249,714 | B1 | 8/2012 | Hartman | |
| 8,585,554 | B2 | 11/2013 | Shavit | |
| 8,613,692 | B2 | 12/2013 | Baudhuin | |
| 8,641,585 | B2 | 2/2014 | LaGree | |
| 9,072,931 | B2 | 7/2015 | Lagree | |
| 9,119,989 | B1 | 9/2015 | Lagree | |
| 9,138,606 | B2 | 9/2015 | Lagree | |
| 9,211,440 | B2 | 12/2015 | Lagree | |
| 9,283,422 | B2 | 3/2016 | Lagree | |
| 9,370,679 | B2 | 6/2016 | Lagree | |
| 9,393,454 | B2 | 7/2016 | Lagree | |
| 10,046,193 | B1 | 8/2018 | Aronson | |
| 10,376,733 | B2 * | 8/2019 | Mahimaidas | A63B 21/4049 |
| 10,716,964 | B1 | 7/2020 | Lagree | |
| 2001/0056011 | A1 | 12/2001 | Endelman | |
| 2003/0032534 | A1 * | 2/2003 | McAfee, Jr. | A63B 21/023 482/133 |
| 2003/0119635 | A1 | 6/2003 | Arbuckle | |
| 2004/0043873 | A1 | 3/2004 | Wilkinson | |
| 2004/0142800 | A1 | 7/2004 | Gerschefske | |
| 2005/0085357 | A1 | 4/2005 | Endelman | |
| 2005/0124471 | A1 | 6/2005 | Wilkinson | |
| 2005/0130810 | A1 | 6/2005 | Sands | |
| 2005/0159278 | A1 | 7/2005 | McVay | |
| 2005/0164856 | A1 | 7/2005 | Parmater | |
| 2006/0046914 | A1 | 3/2006 | Endelman | |
| 2006/0199712 | A1 | 9/2006 | Barnard | |
| 2007/0087921 | A1 | 4/2007 | Graham | |
| 2007/0117693 | A1 | 5/2007 | Illio | |
| 2007/0129226 | A1 | 6/2007 | Leavitt | |
| 2007/0219053 | A1 | 9/2007 | Barufka | |
| 2008/0070765 | A1 | 3/2008 | Brown | |
| 2008/0248935 | A1 | 10/2008 | Solow | |
| 2009/0111661 | A1 | 4/2009 | Hauser | |
| 2009/0118108 | A1 | 5/2009 | Uygan | |
| 2010/0048367 | A1 * | 2/2010 | Liang | A63B 23/03525 482/145 |
| 2010/0099542 | A1 * | 4/2010 | Fernandez | A63B 22/203 482/142 |
| 2010/0227748 | A1 | 9/2010 | Campanaro | |
| 2010/0248911 | A1 | 9/2010 | Myers | |
| 2011/0009249 | A1 | 1/2011 | Campanaro | |
| 2011/0130258 | A1 | 6/2011 | Gerschefske | |
| 2011/0143898 | A1 | 6/2011 | Trees | |
| 2011/0166002 | A1 | 7/2011 | Savsek | |
| 2011/0172069 | A1 | 7/2011 | Gerschefske | |
| 2012/0165168 | A1 | 6/2012 | Simmons | |
| 2012/0295771 | A1 | 11/2012 | Lagree | |
| 2013/0017935 | A1 | 1/2013 | Endelman | |
| 2013/0196835 | A1 | 8/2013 | Solow | |
| 2013/0281269 | A1 | 10/2013 | Gerschefske | |

(56) References Cited

U.S. PATENT DOCUMENTS

| | | | | |
|---|---|---|---|---|
| 2014/0011645 | A1* | 1/2014 | Johnson | A63B 23/03525 482/121 |
| 2014/0100089 | A1 | 4/2014 | Kermath | |
| 2014/0121076 | A1 | 5/2014 | Lagree | |
| 2014/0121078 | A1 | 5/2014 | Lagree | |
| 2014/0121079 | A1* | 5/2014 | Lagree | A63B 21/00065 482/139 |
| 2014/0141948 | A1 | 5/2014 | Aronson | |
| 2014/0221182 | A1 | 8/2014 | Lin | |
| 2015/0024914 | A1 | 1/2015 | Lagree | |
| 2015/0057127 | A1 | 2/2015 | Lagree | |
| 2015/0065318 | A1 | 3/2015 | Lagree | |
| 2015/0065320 | A1 | 3/2015 | Anderson | |
| 2015/0072841 | A1 | 3/2015 | Lagree | |
| 2015/0141204 | A1 | 5/2015 | Lagree | |
| 2015/0217164 | A1 | 8/2015 | Lagree | |
| 2015/0220523 | A1 | 8/2015 | Lagree | |
| 2015/0246263 | A1 | 9/2015 | Campanaro | |
| 2015/0297944 | A1 | 10/2015 | Lagree | |
| 2015/0343250 | A1 | 12/2015 | Lagree | |
| 2015/0360068 | A1 | 12/2015 | Lagree | |
| 2015/0360083 | A1 | 12/2015 | Lagree | |
| 2015/0360113 | A1 | 12/2015 | Lagree | |
| 2015/0364058 | A1 | 12/2015 | Lagree | |
| 2015/0367166 | A1 | 12/2015 | Lagree | |
| 2016/0008657 | A1 | 1/2016 | Lagree | |
| 2016/0059060 | A1 | 3/2016 | Lagree | |
| 2016/0059061 | A1 | 3/2016 | Lagree | |
| 2016/0096059 | A1 | 4/2016 | Lagree | |
| 2016/0166870 | A1 | 6/2016 | Lagree | |
| 2016/0193496 | A1 | 7/2016 | Lagree | |
| 2016/0256733 | A1 | 9/2016 | Lagree | |
| 2016/0271452 | A1 | 9/2016 | Lagree | |
| 2016/0317858 | A1 | 11/2016 | Lagree | |
| 2016/0346593 | A1 | 12/2016 | Lagree | |
| 2016/0361602 | A1 | 12/2016 | Lagree | |
| 2017/0014667 | A1* | 1/2017 | Barnett | A63B 23/03525 |
| 2017/0209728 | A1* | 7/2017 | Lagree | A63B 21/023 |
| 2020/0222741 | A1 | 7/2020 | Aronson | |

OTHER PUBLICATIONS

Pictures of Megaformer M2 Exercise Machine Developed by the Inventor, Sebastien Lagree; Jan. 1, 2011.

Pictures of Megaformer Product Developed by the Inventor, Sebastien Lagree; Printed Feb. 4, 2011.

https://web.archive.org/web/20100501142110/http:/spxfitness.com/index.php?option=com_content&view=article&id=32&Itemid=3; SPX Fitness Superformer Wayback Machine Archive.org Page; May 1, 2010.

Picture of PROFORMER Exercise Machine; Dec. 31, 2008.

Picture of a Product Developed by the Inventor, Sebastien Lagree; 2007.

https://web.archive.org/web/20160405173247/http://static.flickr.com/8480/8186598268_8390c9bc08_b.jpg; MegaFormer M3 Picture Wayback Machine Archive org Page; Dec. 5, 2012.

Https://Twitter.Com/LagreeFitness/Status/635822521997242369; "Can You Handle the Supraformer?"(@LAGREEFITNESS) Twitter Post; Aug. 24, 2015.

Pictures of Megaformer M3 Exercise Machine Developed by the Inventor, Sebastien Lagree; Dec. 15, 2012.

PCT International Search Report and Written Opinion for PCT/US2016/58178; dated Jan. 13, 2017.

Https://Twitter.Com/LagreeFitness/Status/636555280218615808; "Los Angeles: Get Ready for a One of Kind Workout!" (@LAGREEFITNESS) Twitter Post; Aug. 26, 2015.

* cited by examiner

EXERCISE MACHINE CARRIAGE HANDLE SYSTEM

CROSS REFERENCE TO RELATED APPLICATIONS

The present application is a continuation of U.S. application Ser. No. 16/933,517 filed on Jul. 20, 2020 which issues as U.S. Pat. No. 11,395,936 on Jul. 26, 2022, which is a continuation of U.S. application Ser. No. 16/181,259 filed on Nov. 5, 2018 now issued as U.S. Pat. No. 10,716,964 on Jul. 21, 2020, which is a continuation of U.S. application Ser. No. 15/465,773 filed on Mar. 22, 2017 now issued as U.S. Pat. No. 10,118,067, a continuation of U.S. application Ser. No. 15/357,093 filed on Nov. 21, 2016 now issued as U.S. Pat. No. 9,604,095, which is a continuation of U.S. application Ser. No. 15/237,263 filed on Aug. 15, 2016 now issued as U.S. Pat. No. 9,498,667, which is a continuation of U.S. application Ser. No. 14/970,845 filed on Dec. 16, 2015 now issued as U.S. Pat. No. 9,415,253. Each of the aforementioned patent applications, and any applications related thereto, is herein incorporated by reference in their entirety.

BACKGROUND OF THE INVENTION

Field of the Invention

The present invention relates generally to an exercise machine and more specifically it relates to a carriage for an exercise machine that includes handles for an exerciser to grasp with their hands thereby expanding the type of exercises that may be performed.

Description of the Related Art

Any discussion of the related art throughout the specification should in no way be considered as an admission that such related art is widely known or forms part of common general knowledge in the field.

Pilates apparatuses were introduced as exercise devices in the United States during the early 1900's. Today, Pilates is one of the fastest growing fitness activities, and is well known to millions of Pilates exercisers and fitness professionals.

It is also well known that Pilates apparatuses are generally comprised of a rectangular, horizontal base structure with parallel rails aligned with the longitudinal axis of the rectangular structure, and a sliding carriage thereupon that is movably attached to a first end of the structure by springs or elastic bands that produce a resistance bias. Sliding the carriage away from the first end of the apparatus to which one or more spring resistance means are attached creates a workload against which fitness exercises can be beneficially performed.

Some contemporary Pilates apparatuses incorporate a foot bar at the first end of the longitudinal structure such that a user resting their back on a slidable carriage can move the carriage against a spring resistance force by first bending their knees and placing their feet against the foot bar, then straightening their legs, pushing against the stationary foot bar. The axis of the foot bar is positioned typically normal to the longitudinal axis along which the carriage of a Pilates apparatus slides. In some instances, the foot bar also serves as a hand-holding bar during the performance of certain exercises.

In all known instances, features that provide for an accessory structure that an exerciser may push against with their hands or feet, and features that provide for an exerciser to pull with their hands are intended to be used by a person positioned upon and substantially within the perimeter of the Pilates structure. These features are not ergonomically designed for exerciser engagement unless the exerciser is mounted substantially or completely upon the Pilates apparatus. In all cases, they teach away from accessibility to an exerciser substantially positioned outside of the perimeter of the apparatus.

One problem with traditional Pilates apparatuses is that they do not provide for exercisers using the apparatus when positioned adjacent to, and therefore not mounted upon the apparatus. Although many types and number of exercises may be performed on traditional Pilates apparatuses, the inability to perform exercises against the spring resistance means when not mounted on the apparatus limits the types and number of exercises.

Therefore, when a person is able to exercise against the resistance means while positioned next to, and not upon the apparatus, the types and number of exercises increase substantially.

Another problem with traditional apparatuses is that the slidable carriage is typically a substantially horizontal board devoid of features, including holes, bars or handles that would allow an exerciser to grab with their hands, or push against with hands or feet, during the performance of new and beneficial exercises. In other words, the traditional Pilates slidable carriage is merely a rectangular board without grabbing or pushing features.

In theory and in practice, for nearly 100 years, the Pilates Method of exercise has encouraged centering and balance upon an apparatus, and has taught away from performing exercises when the exerciser is not substantially centered upon the apparatus.

The present invention therefore overcomes the limitations of the traditional Pilates method of exercising by promoting resistance exercising for cardiovascular and strength training while positioned partially, or adjacent to the apparatus.

Those skilled in the art will appreciate that today's gym and Pilates studio operators desire a competitive advantage over fitness facilities that merely offer traditional Pilates training classes, and more specifically, desire the ability to provide a broader selection of beneficial exercises that cannot be performed on traditional Pilates apparatuses, and they will further appreciate the commercial value associated with the ability to offer expanded exercise routines.

BRIEF SUMMARY OF THE INVENTION

Provided herein is an exercise machine which includes a frame having a track, a carriage movably connected to the track, a bias member connected between the frame and the carriage, a first handle connected to the carriage near the first side, and a second handle connected to the carriage near the second side. The first handle and second handle are adapted for grasping with a first hand and a second hand respectively of a user during the performance of an exercise on the exercise machine.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
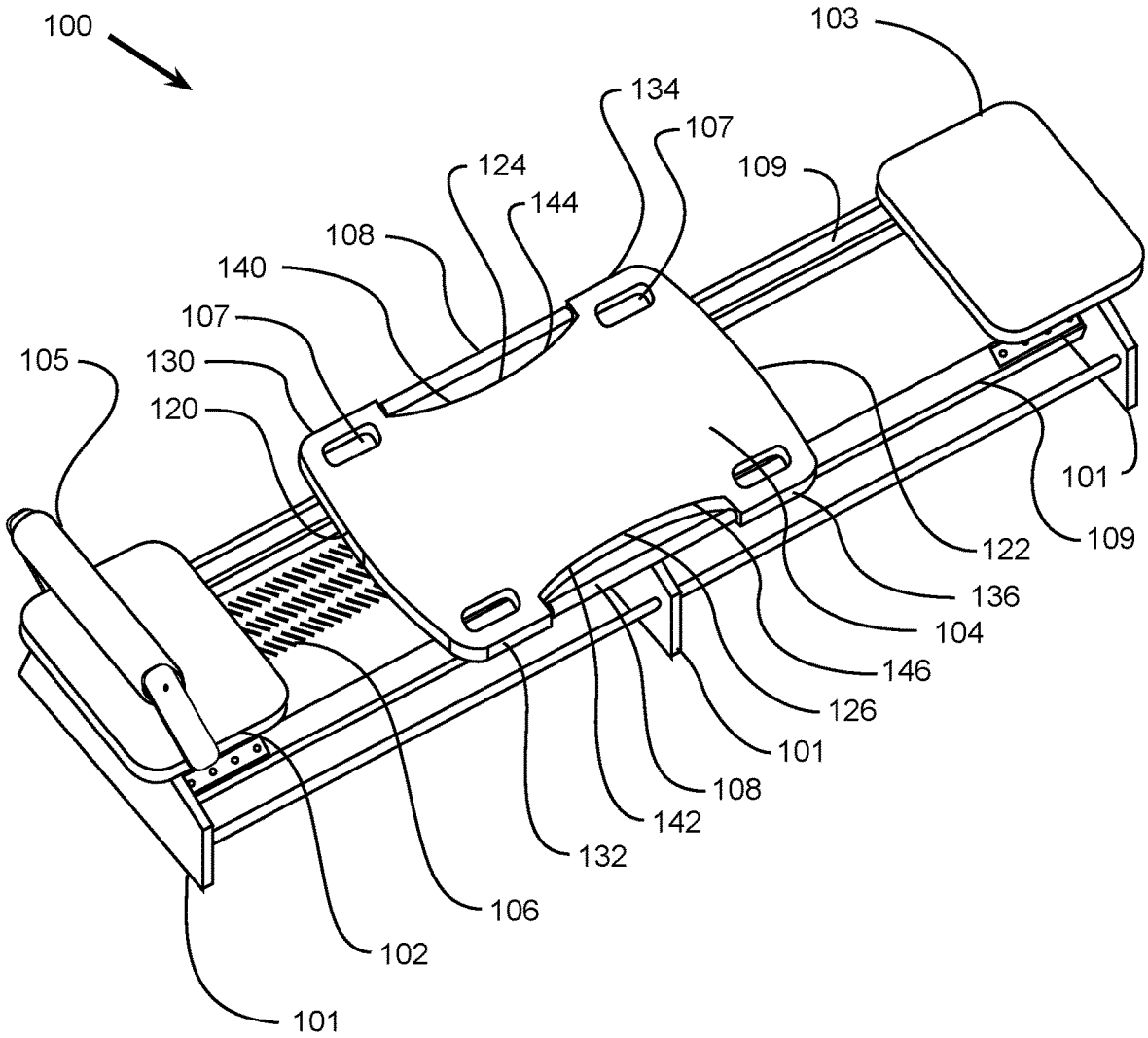
FIG. 1 is an upper perspective view of an exercise machine carriage handle system.

Turning now descriptively to the drawings, in which similar reference characters denote similar elements throughout the several views, FIGS. 1 through 8B illustrate an exercise machine carriage handle system, which comprises a frame having a track, a carriage movably connected to the track, a bias member connected between the frame and the carriage, a first handle connected to the carriage near the first side, and a second handle connected to the carriage near the second side. The first handle and second handle are adapted for grasping with a first hand and a second hand respectively of a user during the performance of an exercise on the exercise machine.

FIG. 1 is an exemplary diagram showing an isometric view of an improved Pilates apparatus.

In the drawing, a Pilates apparatus 100 is shown comprising a support structure with a plurality of support feet 101, a pair of parallel rails 109 extending longitudinally substantially the length of the apparatus 100 and supported by the support structure, an exercise platform 102 and foot bar 105 affixed to a first end of the structure, a slidable carriage 104 slidable upon the rails 109 in response to force exerted by an exerciser, one or more spring bias means 106 removably connected between the slidable carriage 104 and a first end of the apparatus 100, and an exercise platform 103 affixed to a second end of the apparatus 100.

A plurality of hand-holds 107 are shown positioned substantially at the perimeter corners of the slidable carriage 104, the orientation and geometry of the hand-holds 107 being such that an exerciser may easily and comfortably insert their hands and grab the slidable carriage 104 in order to perform an exercise.

Further, a plurality of side rails 108 are shown affixed to the slidable carriage 104, and positioned substantially at the perimeter sides of the carriage 104. The side rail accessories may be comfortably grasped by an exerciser's hands during the performance of an exercise.

It should be noted that, unlike traditional Pilates apparatuses that fail to provide any of the hand-holding features just described, the improved slidable carriage 104 provides a plurality of hand-holding positions accessible to exercisers completely positioned upon the carriage 104 with their spine substantially aligned with the longitudinal axis of the apparatus 100, when positioned partially upon the floor and partially supported by the apparatus 100, or when completely supported by the floor, but grasping the hand-hold features for the performance of an exercise.

Figure 2:
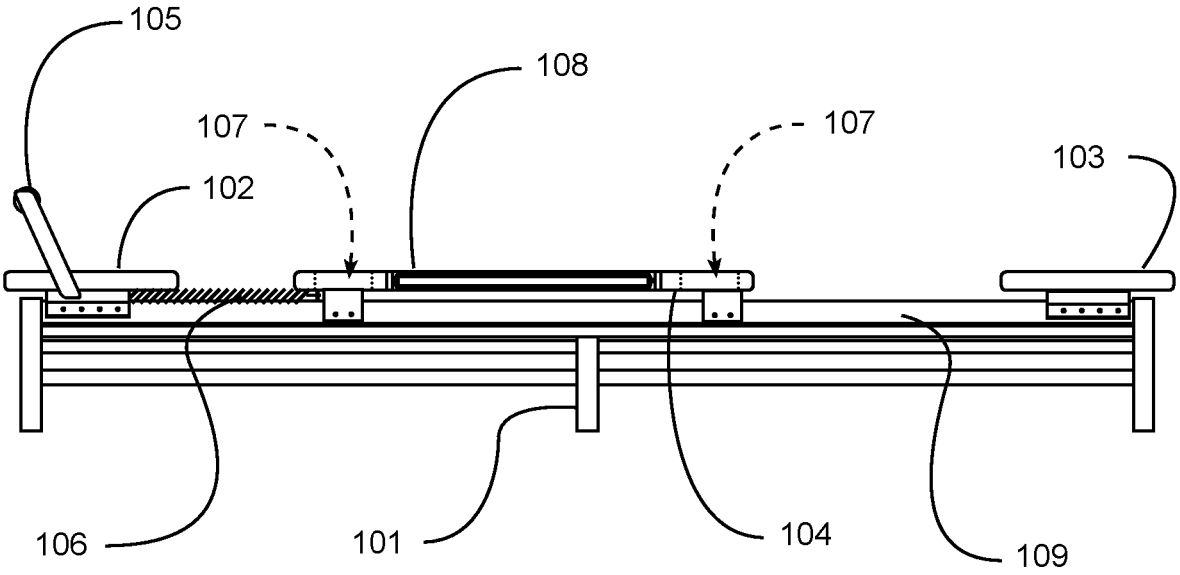
FIG. 2 is a side view of the exercise machine carriage handle system.

FIG. 2 is an exemplary diagram showing a side view of an improved Pilates apparatus.

More specifically, a side view of a substantially rectangular structure of a Pilates apparatus is supported off the floor by a plurality of supporting feet 101. The structure further supports a pair of parallel rails 109 extending substantially the length of the structure, and a slidable carriage 104 thereupon. A plurality of hand-holds 107 not viewable in the side view, and a side grab bar 108 are shown as grabbing features on the slidable carriage 104.

Figure 3:
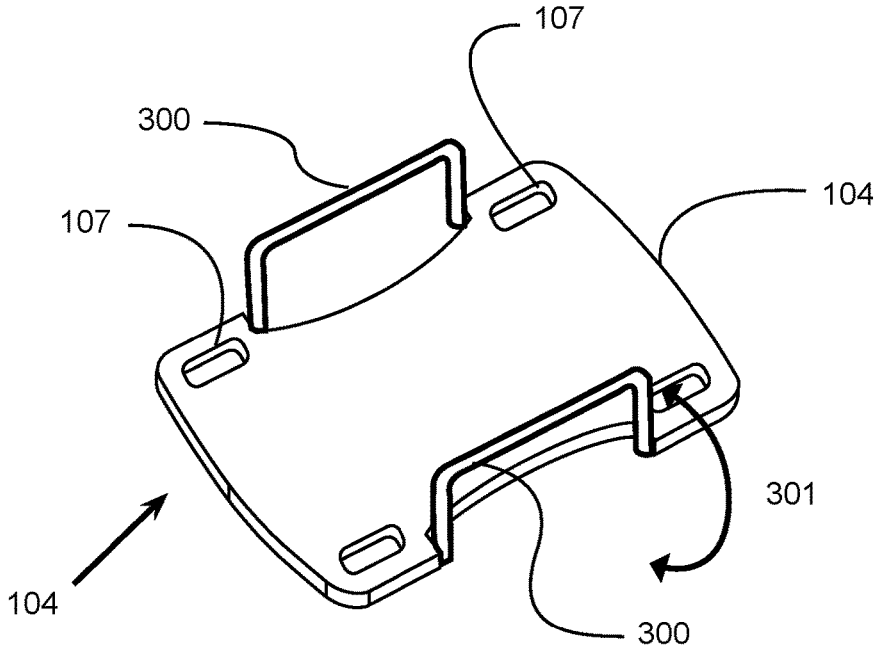
FIG. 3 is an upper perspective view of a first alternative embodiment of the carriage handles.

FIG. 3 is an exemplary diagram showing an isometric view of a slidable carriage of an improved Pilates apparatus.

For purposes of clarity, the supporting structure, parallel rails 109, stationary exercise platforms at the first end and second end of the structure, and spring biasing means 106 are not shown. Only the substantially horizontal exercise surface of the slidable carriage 104 is illustrated.

Now, in the drawing, hand-holds 107 as previously described are shown, with the geometric orientation of the holes being such that they can be easily grasped by an exerciser positioned adjacent to the apparatus 100. Side grab rails 300 are shown positioned substantially along the lateral edges of the slidable carriage 104, with substantially vertical rail supports at each end of the major portion of the grab bar, the grab bar therefore being positioned at an elevation above the exercise surface of the slidable carriage 104. The lateral edges of the slidable carriage 104 are aligned substantially with the longitudinal axis of the Pilates apparatus 100 not shown.

As can be readily appreciated, the vertical and horizontal portions of each of the grab bars may be grasped by an exerciser positioned adjacent to the apparatus 100. The vertical portions may also be grasped by an exerciser and used to push or pull the slidable carriage 104 against the spring biasing means 106 along the longitudinal axis of the apparatus 100.

It should be noted that although the grab bar is shown at an elevation above the exercise surface, the grab bar may also be positioned at an elevation below the exercise surface. Further, although the grab bar accessory is shown as fixed in one location, the bar may also swing 301 to any position within the arc range of motion about a pivot point at the lower end of the vertical grab bar supports. The illustration in the drawing is provided merely as one example of a longitudinally aligned grab bar, and any grab bar in any position above, even with, or below the exercise surface are all anticipated by the present invention.

Figure 4:
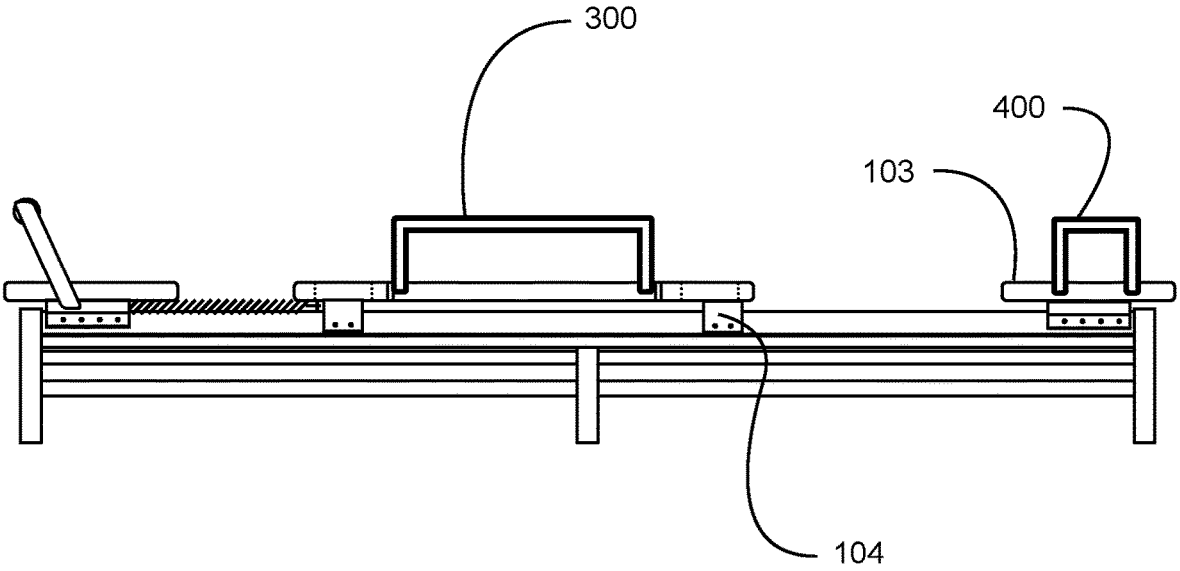
FIG. 4 is a side view of the first alternative embodiment of the carriage handles and handles connected to the end platform of the exercise machine.

FIG. 4 is an exemplary diagram showing a side view of an improved Pilates apparatus.

In the drawing, one raised grab bar 300 of a pair of grab bars is shown affixed to the perimeter edge of a slidable carriage 104. As will be appreciated by those skilled in the art, an exerciser positioned adjacent to the apparatus 100 could perform exercises by grabbing either the vertical support members or the horizontal grab bar.

Further, one smaller grab bar 400 of a pair of grab bars is shown affixed to the perimeter edge of a stationary exercise platform 103.

As previously described, the large grab bar 300 and smaller grab bar 400 may be positioned with the horizontal portion positioned above, even with, or below the exercise surfaces of the platforms, and may be permanently or removably attached.

Figure 5:
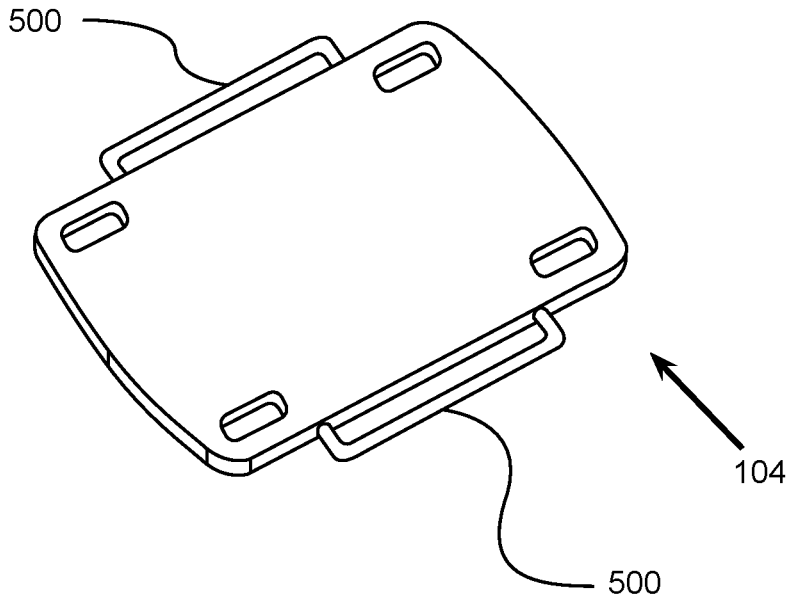
FIG. 5 is an upper perspective view of a second alternative embodiment of the carriage handles.

FIG. 5 is an exemplary diagram showing an alternate isometric view of a slidable carriage of an improved Pilates apparatus.

In the drawing, a pair of grab bars 500 are shown extending beyond the perimeter edge of the exercise surface of a slidable carriage 104 of a Pilates apparatus 100. As one variation of the positioning of grabbing features of the present invention, the grab bars 500 may be permanently or removably attached to the carriage 104.

Figure 6:
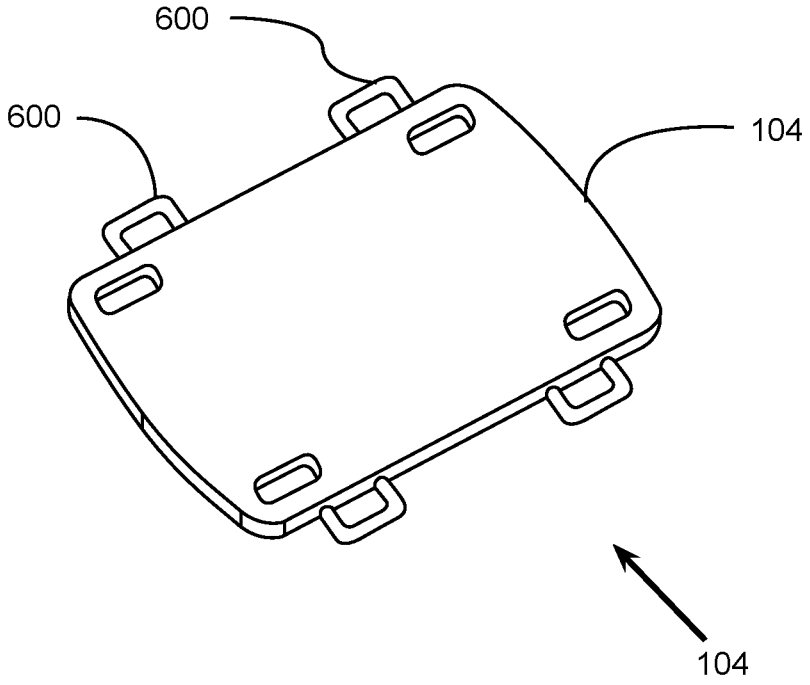
FIG. 6 is an upper perspective view of a third alternative embodiment of the carriage handles.

FIG. 6 is an exemplary diagram showing an alternate isometric view of a slidable carriage of an improved Pilates apparatus.

More specifically, yet another alternative arrangement of a plurality of smaller accessory grab handles 600 are shown variously positioned proximal to and extending beyond the lateral edges of the platform of a slidable carriage 104 of a Pilates apparatus 100. The grab handles 600 may be provided in fixed positions, or may be removably attached to the slidable carriage 104 and relocatable using a plurality of attachment points not shown on the perimeter of the slidable carriage 104.

Figure 7:
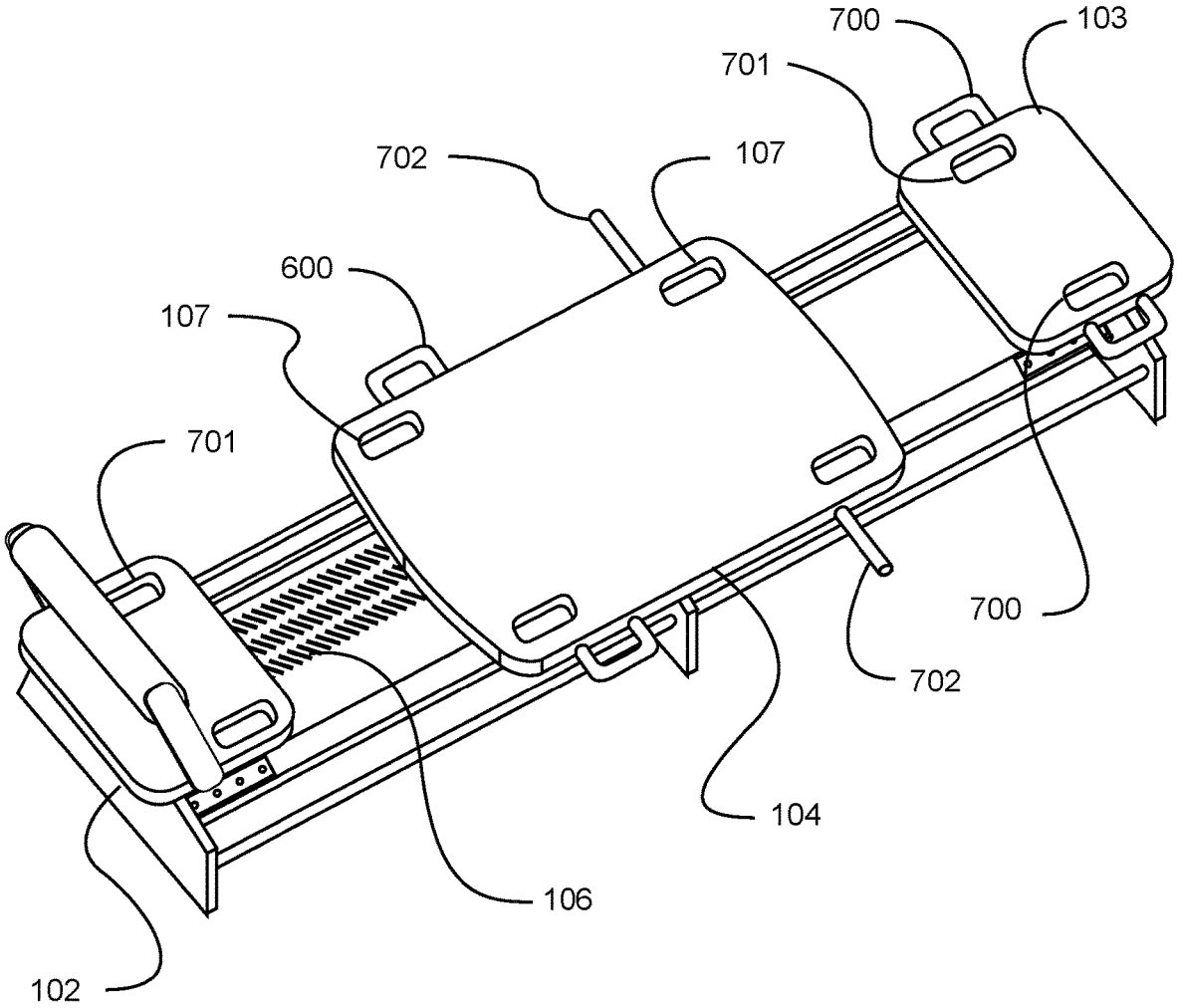
FIG. 7 is an upper perspective view of a fourth alternative embodiment of the carriage handles.

FIG. 7 is an exemplary diagram showing an isometric view of a plurality of accessory features on an improved Pilates apparatus. More specifically, the drawing illustrates a plurality of hand-hold features and accessories of the present invention.

An exerciser may grab one or more hand-hold features 107, 600, 700, 701, 702 positioned substantially at the lateral edges of the exercise platform 102 affixed to a first end of a Pilates apparatus 100, the platform 103 affixed to the second end of the apparatus 100, or the exercise platform of the slidable carriage 104.

More specifically, a plurality of hand-holds 701 are provided proximal to the lateral edges of said exercise platforms, one or more of which may be used by an exerciser whether positioned entirely upon the apparatus 100, or preferably when partially supported by the apparatus 100 and floor, or entirely supported by the floor.

Further, one or more grab handles 600, 700 may be positioned at various locations along the lateral edges of the carriage 104, and/or may be positioned along the lateral edges of the stationary platform 103 or 102.

Still further, push bars 702 may be affixed to the slidable carriage 104, extending laterally from the perimeter edge of the platform, thereby providing a structure against which an exerciser may push with a force against the spring biasing means 106.

Therefore, the types and number of hand-holds and push bars as illustrated is not meant to be limiting, and the placement, size, distance above or below the exercise surfaces, or the distance of extension laterally beyond the perimeter of the exercise surface may vary as may be required to properly perform various exercises when positioned adjacent to, or partially supported by a traditional Pilates apparatus.

It should be noted that any of the accessory handles, grab bars or foot bars may be permanently attached, or removably attached to the slidable carriage 104, the stationary exercise platforms located at distal ends of the apparatus 100, or to the structure of a Pilates apparatus 100.

Figure 8A:
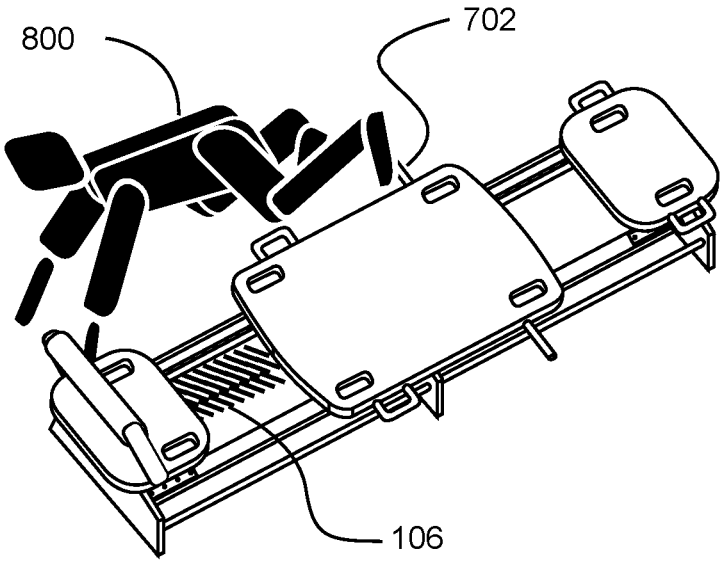
FIG. 8A is an upper perspective view of the exercise machine having the fourth alternative embodiment of the carriage handles along with an exerciser pushing with a foot against an accessory extending from the carriage.

FIG. 8A is an exemplary diagram showing an isometric view of an exerciser pushing with a foot against an accessory of an improved Pilates apparatus.

Merely as a means to illustrate the use of an improved Pilates apparatus of the present invention, the drawing shows a representative exerciser 800 supported on the floor by both arms and one knee. One foot is raised and positioned upon a foot push bar 702 such that extending the leg will require a force sufficient enough to overcome the resistance created by the spring biasing means 106.

As would be immediately recognized by a skilled artisan, the representative exercise just described cannot be performed on a traditional Pilates apparatus absent the push bar accessory of the present invention.

Figure 8B:
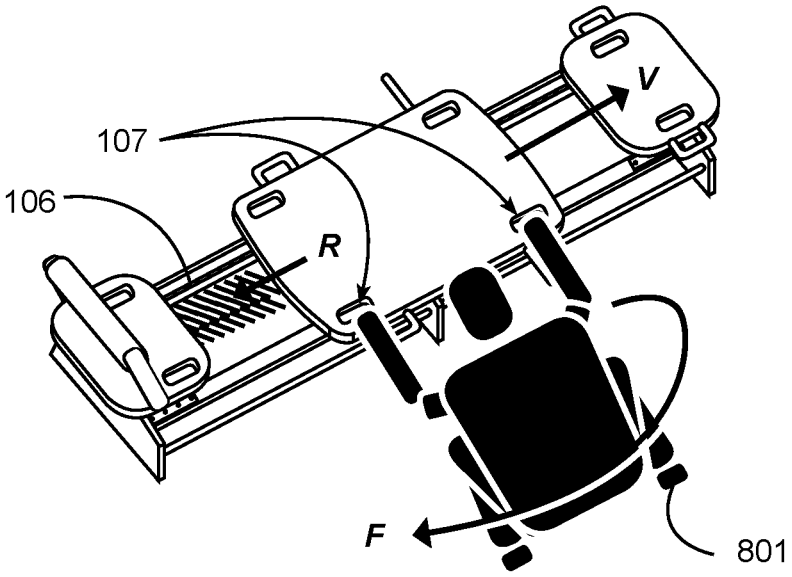
FIG. 8B is an upper perspective view of the exercise machine of FIG. 8A with an exerciser dismounted from the exercise machine, grabbing handles on the side of the carriage.

FIG. 8B is an exemplary diagram showing an isometric view of an exerciser dismounted from a Pilates apparatus, grabbing hand hold accessory features of an improved Pilates apparatus.

A one more means of illustrating the use of an improved Pilates apparatus of the present invention, the drawing shows a representative exerciser 801 kneeling on the floor, positioning both hands in hand-holds located on the perimeter corners of the slidable carriage 104. In the performance of a torso-twist exercise, the exerciser 801 rotates the torso clockwise as shown, creating a rotational force F such that when transferred through the arms, creates a force in the vector direction V sufficient enough to overcome the resistance R created by the spring biasing means 106.

By completing a number of repetitions of the exercise just described, the exerciser 801 will have strengthened certain core muscles including the internal and external obliques, ractus abdominus and external incercostal muscles, to name a few.

The frame of the exercise machine includes a track, a first end and a second end. The track has a longitudinal axis. The track is comprised of one or more rails 109 that the carriage 104 is movably connected to.

The carriage includes an upper surface, a lower surface opposite of the upper surface, a first end, a second end opposite of the first end, a first side and a second side opposite of the first side. The carriage is movably connected to the track and adapted to be movable along a portion of the longitudinal axis of the track in a reciprocating back-and-forth motion. At least one bias member (e.g. spring) is connected between the frame and the carriage to provide a biasing force to the carriage.

At least one first handle is connected to the carriage preferably near, adjacent or on the first side. The first handle is adapted for grasping with a first hand of a user. Furthermore, at least one second handle is connected to the carriage preferably near, adjacent or on the second side. Similar to the first handle, the second handle is also adapted for grasping with a second hand of the user. The first and second handles may have various shapes, sizes and configurations suitable for grasping by an exerciser. For example, the first handle and the second handle may each have a U-shaped structure that mirrors one another in one embodiment.

The first handle and the second handle are preferably substantially parallel with respect to one another, however, the handles are not required to be substantially parallel with respect to one another. The first handle and the second handle are preferably substantially parallel with respect to the upper surface of the carriage, but are not required to be substantially parallel with respect to the upper surface of the carriage. In one embodiment of the exercise machine carriage handles, the pair of opposing handles are substantially parallel with respect to one another and the upper surface of the carriage. The handles preferably have an upper surface that is near or aligned with the upper surface of the carriage. The handles may extend outwardly from the carriage or have a substantially flush relationship with the upper surface and/or respective sides of the carriage.

A first opening may be formed between the first handle and the carriage, and a second opening may be formed between the second handle and the carriage. The openings allow portions of the hands of the exercise to extend through when the user is grasping the carriage or the handles. The first side and the second side of the carriage each may include a portion that is inwardly curved.

The first handle and the second handle may be comprised of an elongated structure such as a substantially straight structure having a cylindrical shape (e.g. cylindrical rod, cylindrical tube, etc.). The handles do not have to be elongated, straight or cylindrical and instead may have various other types of shapes suitable for grasping by an exerciser. The handles further may each have a longitudinal axis that is parallel with respect to the longitudinal axis of the frame and/or track of the exercise machine. The handles may be angled at various non-parallel angles with respect to the carriage and one another (e.g. the handles may extend outwardly away from the carriage from a first end to a second end of the handles).

The carriage may include a first pair of extended portions that extend outwardly from the first side of the carriage with the first handle attached between the first pair of extended portions forming the first opening between the first handle and the carriage. The carriage may also include a second pair of extended portions that extend outwardly from the second side of the carriage with the second handle attached between the second pair of extended portions forming a second opening between the second handle and the carriage. The extended portions are not required to connect the handles to the carriage as shown in the figures. The first pair of extended portions and the second pair of extended portions each include opposing surfaces that said first handle and said second handle are connected to respectively. Alternatively, the first handle and second handle may extend outwardly from the first side and second side of the carriage respectively.

The first handle and the second handle each may have a first distal end that is near, adjacent or at the first end of the carriage and a second distal end that is near, adjacent or at the second end of the carriage. The distal ends of the handles do not have to be near the ends of the carriage.

The first handle and second handle may extend outwardly from the carriage to the side, upwardly or at an angle between thereof. The first handle and second handle may extend upwardly from, near or adjacent the first side and second side of the carriage respectively. The handles do not have to extend outwardly from the carriage.

As shown in FIG. 1, the carriage 104 includes a first side handle 140 comprised of a portion of the first side 124 of the carriage 104 that extends from the first extended portion 130 in a direction towards the second end 122 of the carriage 104 and that tapers inwardly. As shown in FIG. 1, the carriage 104 includes a second side handle 142 comprised of a portion of the second side 126 of the carriage 104 that extends from the second extended portion 132 in a direction towards the second end 122 of the carriage 104 and that tapers inwardly. As shown in FIG. 1, the carriage 104 includes a third side handle 144 comprised of a portion of the first side 124 of the carriage 104 that extends from the third extended portion 134 in a direction towards the first end 120 of the carriage 104 and that tapers inwardly. As shown in FIG. 1, the carriage 104 includes a fourth side handle 146 is comprised of a portion of the second side 126 of the carriage 104 that extends from the fourth extended portion 136 in a direction towards the first end 120 of the carriage 104 and that tapers inwardly.

As shown in FIG. 1, the first side handle 140, the second side handle 142, the third side handle 144 and the fourth side handle 146 may be curved. The first side 124 and the second side 126 of the carriage 104 each may include a central portion that is substantially parallel with respect to the longitudinal axis of the frame.

As further shown in FIG. 1, the first extended portion 130 includes an outer edge, the second extended portion 132 includes an outer edge, the third extended portion 134 includes an outer edge, and the fourth extended portion 136 includes an outer edge. As shown in FIG. 1, the outer edges of the extended portions 130, 132, 134, 136 are preferably straight. As shown in FIG. 1, the outer edges of the extended portions 130, 132, 134, 136 are preferably parallel with respect to the longitudinal axis of the frame. As shown in FIG. 1, the outer edges of the first extended portion 130 and the third extended portion 134 are preferably aligned with one another. As shown in FIG. 1, the outer edges of the second extended portion 132 and the fourth extended portion 136 are preferably aligned with one another.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An exercise machine, comprising:

a frame having at least one rail, a first end and a second end, wherein the frame has a longitudinal axis;

a carriage having an upper exercise surface, a first end, a second end opposite of the first end, a first side and a second side opposite of the first side, wherein the carriage is movably connected to the at least one rail and adapted to be movable along a portion of the longitudinal axis of the frame during execution of an exercise;

a first grab bar extending outwardly and horizontally the first side of the carriage, wherein the first grab bar is comprised of a U-shaped structure;

a second grab bar extending outwardly and horizontally the second side of the carriage, wherein the second grab bar is comprised of a U-shaped structure;

wherein the first grab bar and the second grab bar extend beyond a perimeter edge of the upper exercise surface of the carriage;

a first opening between the first grab bar and the first side of the carriage;

a second opening between the second grab bar and the second side of the carriage;

a first end platform connected to the frame and positioned near the first end of the frame, wherein the first end platform includes an upper exercise surface; and wherein the upper exercise surfaces of the carriage and the first end platform are parallel and aligned with respect to one another.

2. The exercise machine of claim 1, wherein the first grab bar and the second grab bar are each centrally located with respect to the carriage.

3. The exercise machine of claim 1, wherein the first grab bar and the second grab bar each include a longitudinal portion that is parallel with respect to the longitudinal axis of the frame.

4. The exercise machine of claim 1, wherein the first grab bar and the second grab bar each include a longitudinal portion that is straight and parallel with respect to the longitudinal axis of the frame.

5. The exercise machine of claim 1, wherein the first grab bar mirrors the second grab bar.

6. The exercise machine of claim 1, wherein the first grab bar and the second grab bar are each permanently attached to the carriage.

7. The exercise machine of claim 1, wherein the first grab bar and the second grab bar are each removably attached to the carriage.

8. The exercise machine of claim 1, including a second end platform connected to the frame and positioned near the second end of the frame, wherein the second end platform includes an upper exercise surface.

9. The exercise machine of claim 8, wherein the upper exercise surfaces of the carriage, the first end platform and the second end platform are parallel and aligned with respect to one another.

10. The exercise machine of claim 1, wherein the first opening and the second opening each have a rectangular shape.

11. An exercise machine, comprising:

a frame having at least one rail, a first end and a second end, wherein the frame has a longitudinal axis;

a carriage having an upper exercise surface, wherein the carriage is movably connected to the at least one rail and adapted to be movable along a portion of the longitudinal axis of the frame during execution of an exercise;

a first end platform connected to the frame and positioned near the first end of the frame, wherein the first end platform includes an upper exercise surface, a first side and a second side opposite of the first side;

wherein the upper exercise surfaces of the carriage and the first end platform are parallel and aligned with respect to one another;

a first grab handle extending outwardly and horizontally the first side of the first end platform, wherein the first grab handle is comprised of a U-shaped structure;

a second grab handle extending outwardly and horizontally the second side of the first end platform, wherein the second grab handle is comprised of a U-shaped structure;

wherein the first grab handle and the second grab handle extend beyond a perimeter edge of the upper exercise surface of the first end platform;

a first opening between the first grab handle and the first side of the first end platform; and a second opening between the second grab handle and the second side of the first end platform.

12. The exercise machine of claim 11, wherein the first grab handle and the second grab handle are each centrally located with respect to the first end platform.

13. The exercise machine of claim 11, wherein the first grab handle and the second grab handle each include a longitudinal portion that is parallel with respect to the longitudinal axis of the frame.

14. The exercise machine of claim 11, wherein the first grab handle and the second grab handle each include a longitudinal portion that is straight and parallel with respect to the longitudinal axis of the frame.

15. The exercise machine of claim 11, wherein the first grab handle mirrors the second grab handle.

16. The exercise machine of claim 11, wherein the first grab handle and the second grab handle are each permanently attached to the first end platform.

17. The exercise machine of claim 11, wherein the first grab handle and the second grab handle are each removably attached to the first end platform.

18. The exercise machine of claim 11, including a second end platform connected to the frame and positioned near the second end of the frame, wherein the second end platform includes an upper exercise surface, and wherein the upper exercise surfaces of the carriage, the first end platform and the second end platform are parallel and aligned with respect to one another.

19. The exercise machine of claim 11, wherein the first opening and the second opening each have a rectangular shape.

20. An exercise machine, comprising:

a frame having at least one rail, a first end and a second end, wherein the frame has a longitudinal axis;

a carriage having an upper exercise surface, wherein the carriage is movably connected to the at least one rail and adapted to be movable along a portion of the longitudinal axis of the frame during execution of an exercise;

a bias member adapted to be connected to the carriage, wherein the bias member provides a biasing force to the carriage;

a first end platform connected to the frame and positioned near the first end of the frame, wherein the first end platform includes an upper exercise surface, a first side and a second side opposite of the first side;

wherein the upper exercise surfaces of the carriage and the first end platform are parallel and aligned with respect to one another;

a first grab handle extending outwardly from the first side of the first end platform, wherein the first grab handle is comprised of a U-shaped structure;

a second grab handle extending outwardly from the second side of the first end platform, wherein the second grab handle is comprised of a U-shaped structure;

wherein the first grab handle and the second grab handle extend beyond a perimeter edge of the upper exercise surface of the first end platform;

wherein the first grab handle and the second grab handle are each centrally located with respect to the first end platform;

wherein the first grab handle and the second grab handle each include a longitudinal portion that is straight and parallel with respect to the longitudinal axis of the frame;

wherein the first grab handle mirrors the second grab handle;

a first opening between the first grab handle and the first side of the first end platform;

a second opening between the second grab handle and the second side of the first end platform; and a second end platform connected to the frame and positioned near the second end of the frame, wherein the second end platform includes an upper exercise surface, and wherein the upper exercise surfaces of the carriage, the first end platform and the second end platform are parallel and aligned with respect to one another.

* * * * *